US007073868B1

(12) United States Patent
Turner

(10) Patent No.: US 7,073,868 B1
(45) Date of Patent: Jul. 11, 2006

(54) OPTIMIZED KINETIC ENERGY MACHINE FOR EXCAVATING UNDERWATER ROCK

(76) Inventor: Thomas Miles Turner, 1459 Bay Point Dr., Sarasota, FL (US) 34236

( * ) Notice: Subject to any disclaimer, the term of this patent is extended or adjusted under 35 U.S.C. 154(b) by 0 days.

(21) Appl. No.: 10/703,060

(22) Filed: Nov. 6, 2003

Related U.S. Application Data

(60) Provisional application No. 60/493,735, filed on Aug. 11, 2003.

(51) Int. Cl.
*E21C 50/00* (2006.01)
*E21C 25/06* (2006.01)

(52) U.S. Cl. ..... 299/77; 299/10; 37/327

(58) Field of Classification Search ..... 37/327, 37/328; 299/77, 79.1, 75
See application file for complete search history.

(56) References Cited

U.S. PATENT DOCUMENTS 506,354 A * 10/1893 Yerrington ..... 37/327
705,784 A * 7/1902 Perry ..... 37/327
727,691 A * 5/1903 Robinson ..... 37/327
797,109 A * 8/1905 Harris ..... 37/328
1,821,177 A * 9/1931 Ellis ..... 37/327
3,760,518 A * 9/1973 Hamm ..... 37/328

* cited by examiner

*Primary Examiner*—John Kreck

(57) ABSTRACT

A machine for improved excavation of underwater rock that eliminates failures due to over-stressed cutting teeth by positioning each hardened tooth for optimized Kinetic Energy. It has a plurality of blades, each with a hub and a plurality of spokes connecting the hub to a rim. Teeth are mounted on the leading edge of each blade approximately equidistant from the cutter axis of rotation, allowing each tooth to have the proper combination of velocity and cutting force required to shatter massive, hard rock. As a result, all teeth have approximately the same peripheral velocity; have adequate Kinetic Energy to shatter rock upon impact, and are subject to approximately the same maximum stress during rock excavation.

8 Claims, 3 Drawing Sheets

OPTIMIZED KINETIC ENERGY MACHINE FOR EXCAVATING UNDERWATER ROCK

CROSS REFERENCE TO RELATED APPLICATIONS

This is a continuation of Provisional Patent Application entitled Dredge Cutterhead for Rock With Optimized Velocity Capability, Ser. No. 60/493,735, filed on Aug. 11, 2003 by the same inventor for the same subject matter.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION—FILED OF THE INVENTION

This invention relates generally to the field of excavating hard, massive rock, and more specifically to a cutterhead, hydraulic dredge, and method for excavating said rock underwater, whereby the configuration of the cutter and blade placement equidistant from the shaft assist in causing the application of proper Kinetic Energy to rock to assure its disintegration without premature failure of cutting blades. Previously, the industry has always relied upon the shearing strength of a cutter on the soil. However, rock does not shear, it must be shattered. The proper combination of cutting force and tooth velocity achieved in the present invention roughly doubles the capacity of a cutter and halves the unit cost of dredging a cubic yard.

For hundreds of years, Man has used various methods to dredge his shipping channels. He progressed from the hand-held shovel to mechanized buckets such as the dragline, clamshell, dipper and backhoe. He also developed the hydraulic dredge which utilized an excavator called the cutter or cutterhead. This tool excavated underwater soil and directed it to a high velocity stream of water entering the pumping system, which was then sent as a slurry of water and solids to the disposal area via pipeline.

Dredges, whether mechanical or hydraulic, have historically been limited in the material they could excavate. Massive, hard rock has low elasticity and must be shattered, not sheared. It was initially considered impossible to dredge, and the mechanical or bucket dredge is still severely limited on hard rock. However, the hydraulic dredge has progressed in its development of rock cutters, and in recent decades, has had some success in dredging rock, although generally accompanied by problems and sometimes failure, including project abandonment. In contrast, the present invention overcomes such problems for successful shattering of massive hard rock.

Mechanical dredges with various types of bucket excavators have attempted to dig hard rock by forcing the bucket into the rock in an effort to shear it. Unless said rock was soft, these efforts inevitably failed, regardless of the unit pressure brought to bear. Massive, friable rock responds poorly to attempts to shear it, requiring instead shattering by impact analogous to the jack hammer on concrete. Dredge operators soon learned that the impacts of the cutterhead teeth of the hydraulic dredge on rock were more effective than mechanical buckets, and efforts were made to further improve the cutter's effectiveness on rock. FIG. 1 shows the current state of the art of a rock cutterhead, which incorporates hardened, quickly-changed teeth mounted in adaptors on each of the several blades of the cutter. It is the teeth mounted in adaptors that precede the blades and protect them from contact with solid rock so that such contact seldom occurs in the absence of tooth failure. The pictured cutter is approximately ten feet in diameter, driven at the back ring by 4000 hp at approximately 30 RPM. It is a massive, complex, and expensive device. However, with its graceful blade arcs and symmetrical teeth it is a thing of beauty and a formidable tool, but its design is flawed as while it succeeded in digging hard rock, but it also suffered numerous failures in teeth and adaptors, greatly increasing downtime and unit costs, and decreasing production rate.

Cutter horsepower and cutting force are not the most significant factors in rock dredging. Rock must be shattered by impact, as measured by the Kinetic Energy of the cutter teeth in units of ft-lbs. Rock dredging experience along the U.S. east coast discloses that the limestone can be excavated by cutters with a Kinetic Energy of at least 500,000 ft-lbs using nominal cutter size, but more accurately for present invention purposes. Kinetic Energy of approximately 611,000 ft-lbs is required at the tip of each cutter tooth. Successful rock dredging, though difficult, can be accomplished by a sturdy pinned tooth cutter where each tooth exceeds the necessary Kinetic Energy to shatter rock of 611,000 ft-lbs, and whereby the total cutter force is concentrated on each tooth, as in the structure of the present invention. The prior art cutter shown in FIG. 1 has six blades (or arms) with eight teeth on each blade. Note that as the blades curve into the drive shaft hub at the closed end of the cutter, there are hardened teeth to shield the softer blades from direct contact with the rock. These teeth are necessarily closer to the cutter's rotational axis, meaning that while they rotate at the same RPM as the outer teeth, they run at a slower peripheral velocity, reducing their Kinetic Energy (KE) as expressed by the classic equation: $KE=MV^2/2g$, where M=total cutter force in pounds; V=tooth tip velocity in ft/sec; and g=the acceleration of gravity (32.2 ft/sec/sec). Since KE varies as the square of tooth velocity, the KE of a tooth closer to the shaft is reduced significantly, and said tooth invariably encounters rock that is not shattered by the low velocity and inadequate KE. This leaves intact rock to resist the force of said tooth, causing failure of said tooth (and/or adaptor) which can be exposed to most, if not the total cutting force. To prevent failure, it is necessary that each tooth have the required Kinetic Energy to shatter rock upon impact. Excessive horsepower and its proportional cutting force can be detrimental without adequate tooth velocity, causing greater tooth failure than a lesser cutting force. Horsepower should not be confused with Kinetic Energy or work. While work is expressed in ft-lbs with one ft-lb defined as the energy to raise one pound through one foot of elevation, horsepower is the rate of doing work or expending energy in ft-lbs/minute, with one horsepower equal to 33.000 ft-lbs/minute. Further, while as mentioned above the Kinetic Energy varies as the square of tooth velocity, the horsepower (HP) in ft-lbs/minute of a cutter of a given diameter varies directly with the total cutting force (M in lbs) and RPM. Thus. $HP=M\times RPM\times D\times Pi/33{,}000$, where D is the cutter diameter. When horsepower is defined in terms of torque (T), with $T=M\times D/2$ as measured in ft-lbs, the formula for horsepower becomes $HP=T\times RPM/5252$. Thus, in the HP equation, if the cutting force M is reduced by half and the horsepower or rate of doing work is to remain the same, the velocity of the cutters must be doubled. However, in the Kinetic Energy equation, it can be seen that the cutting force M is reduced by half and the cutter velocity is doubled, since V is squared to 4, twice the Kinetic Energy is netted and results in increasing the capability of the existing drive. Reduced horsepower HP and cutting force M results in lighter, less expensive equipment, such as the present invention, while the higher tooth velocity used increases the capability of the cutter, a win—win situation.

SUMMARY OF THE INVENTION

The primary object of this invention is to increase the capacity and effectiveness of rock excavators, particularly hydraulic dredge cutters. Another object of this invention is to minimize excavator parts failure. Yet another object of this invention is to assure adequate tooth velocity and cutting force to shatter the rock upon impact. Another object of this invention is to optimize the combined application of cutter force and tooth velocity on each tooth. A further object of this invention is to eliminate over-stress on cutter teeth and adaptors. Still yet another object of this invention is to minimize horsepower and cutting force while increasing rock-cutting capability. Another object of this invention is to reduce capital costs attendant to cutter horsepower (winches, flotation, and the like) while improving rock excavation. A broad objective of this invention is to encourage the dredging industry to utilize the concept of Kinetic Energy for hard rock dredging, since the old concepts based upon horsepower and unit pressure are inadequate. Other objects and advantages of the present invention will become apparent in the following descriptions, taken in connection with the accompanying drawings, wherein, by way of illustration and example, a preferred embodiment of the present invention is disclosed.

In accordance with the preferred embodiment of the present invention, there is disclosed a machine for excavating underwater rock by optimizing the Kinetic Energy (KE) of each hardened tooth of an excavator comprising a plurality of blades on a rotating cutter, with said teeth mounted on said blades approximately equidistant from the cuttcr's rotational axis, allowing the proper combination of tooth speed and cutting force required to shatter rock. Thus, each tooth:

a) has the same or approximately the same adequate peripheral velocity for shattering rock;
b) has adequate Kinetic Energy to shatter the rock upon impact; and
c) is subject to the same maximum stress, preferably but not essentially, less than the strength of the tooth and adaptor.

As a result of the operating conditions noted above, the strength of each tooth and adaptor on the present invention can be designed to exceed the fixed maximum operating stress, and tooth and adaptor failure are thus reduced since stresses higher than the design capability are no longer caused by the intact rock it encounters. Further, the minimized need to replace broken teeth and adaptors reduces dredge downtime and the cost per cubic yard of dredged rock, including parts and labor. In addition, the high speed action of the present invention cutting teeth provides a smoother rock-cutting operation. Prior art cutters of underwater massive, hard rock often experience excessive tooth and adaptor failure, due to the positioning of a portion of the cutter teeth closer to the rotational axis where they are subject to higher drive forces. The prior art cutter teeth located closer to the cutter's rotational axis have less velocity, and therefore less Kinetic Energy for shattering rock. In contrast, the present invention cutter provides a simplified cutter with a simple hub, and several spokes extending between the hub and a rim, with all of the cutter's teeth being positioned on the rim at approximately the same distance from its rotational axis. As a result, each tooth present has the same peripheral velocity, is subject to the same maximum stress, and has adequate Kinetic Energy to shatter massive, hard rock upon impact. Thus, the present invention eliminates the excessive and premature failure experienced with prior art cutter teeth and adaptors, resulting in greater rock cutting capability, greater operational efficiency, less downtime, and reduced operational cost. Further, the simplified design of the present invention cutter, with its simple hub/spokes/rim configuration, reduces manufacturing costs.

BRIEF DESCRIPTION OF THE DRAWINGS

The drawings accompanying this specification include exemplary embodiments of the invention, which may be embodied in various forms. It is to be understood that in some instances various aspects of the invention may be shown in simplified or exaggerated form to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
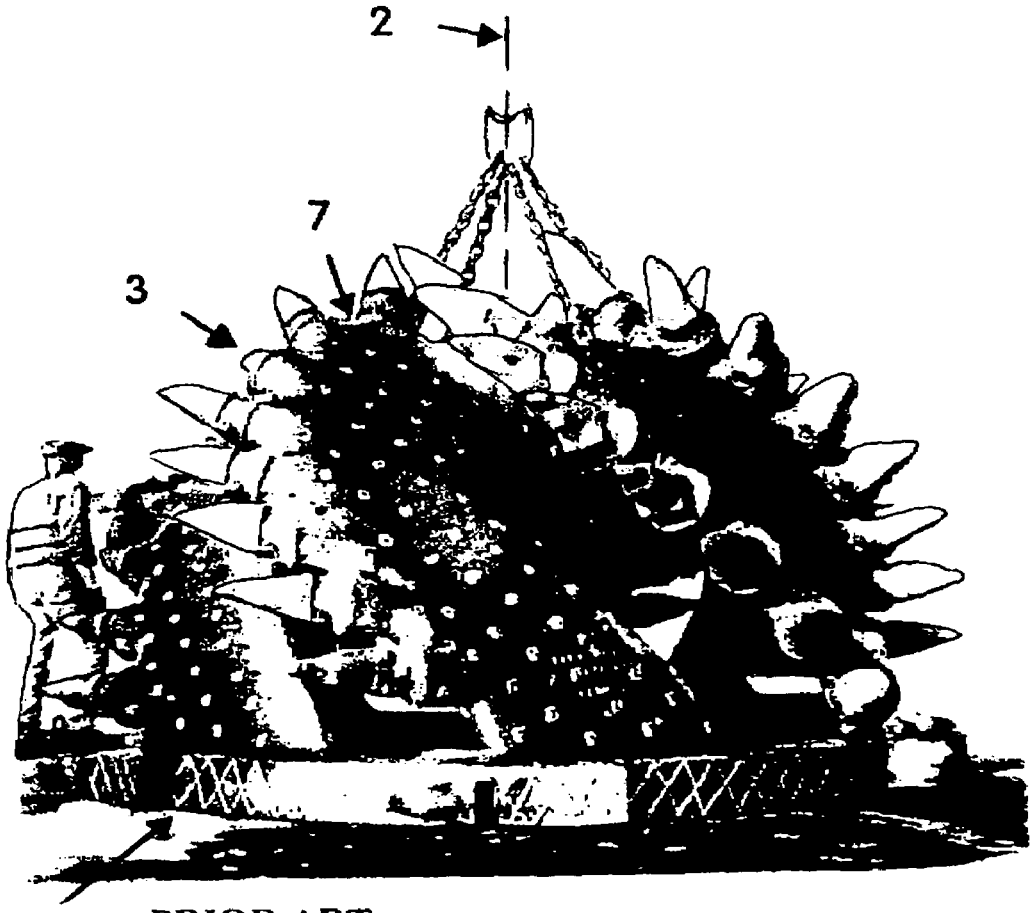
PRIOR ART FIG. 1
FIG. 1 is a side view of a prior art dredge cutter, circa 2003, showing the cutter complete with teeth mounted in adaptors and an arrow pointing to a failed tooth and adaptor.

FIG. 1 shows a large, state-of-the-art dredge rock cutter which has had some success excavating underwater rock, but which has been hampered by excessive adaptor and tooth failure, resulting in high costs per cubic yard of rock excavated. The parts failure involved the first five teeth of the eight teeth on each blade, counting from the top (closed end) of the cutter. These teeth are closer to the cutter rotational axis 2 and are subject to higher drive forces than the teeth located farther from cutter rotational axis 2. For example, a tooth twice as far from cutter rotational axis 2 would have only one-half the maximum stress of a tooth positioned half as far from cutter rotational axis 2. Also, the teeth closer to cutter rotational axis 2 would have less velocity than the teeth positioned father away from cutter rotational axis 2. For example a tooth positioned twice as far from cutter rotational axis 2 than a second tooth would have twice the peripheral velocity of the closer tooth, thus increasing the Kinetic Energy by four times (since Kinetic Energy varies as the square of tooth velocity, $KE=MV^2/2g$).

In order to prevent the cutter part failures experienced in prior art devices, this invention eliminates the over-stressed teeth by placing all teeth and adaptors 3 approximately equidistant from cutter rotational axis 2, while operating the cutter at an RPM that provides the required Kinetic Energy to each to shatter the rock upon impact. This avoids the need for the complex curves of the blades on the prior art cutter that arc back into the hub 1, allowing their replacement by the simple present invention hub 1 with its extended spokes 4 and a rim 5. Therefore, in addition to a decreased cost of operation over the prior art, the simplified design of the present invention cutter also reduces manufacturing cost.

Figure 2:
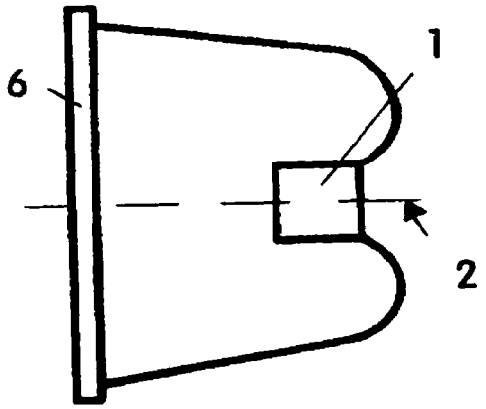
PRIOR ART FIG. 2
FIG. 2 is a simplified schematic profile of the prior art cutter with blades arcing into the hub.
Figure 3:
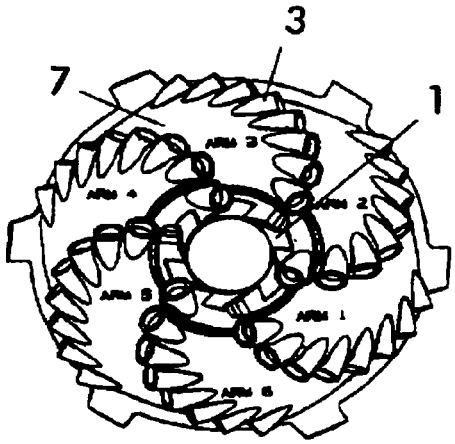
PRIOR ART FIG. 3
FIG. 3 is an end view of the prior art cutter showing the approximate location of the adaptors with respect to the cutter axis, teeth omitted.
Figure 4:
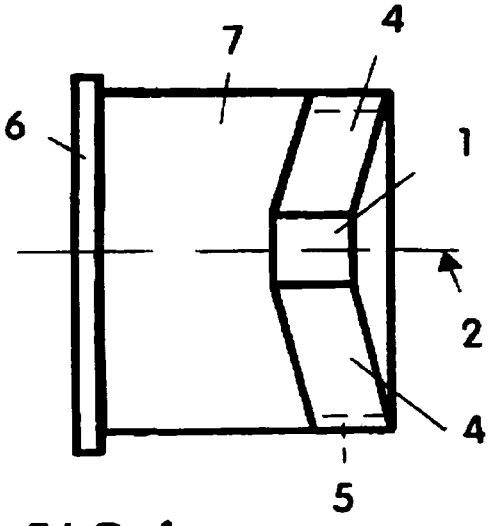
FIG. 4 is a simplified schematic profile view of the cutter in the most preferred embodiment of the present invention.
Figure 5:
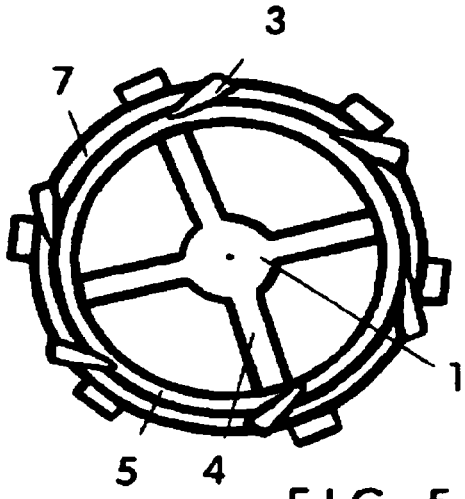
FIG. 5 is an end view of the cutter in the most preferred embodiment of the present invention showing the positioning of a few of the many teeth that are located on the periphery of the cutter, with each being equidistant from the cutter axis and thereby having the required Kinetic Energy to shatter rock upon impact.

FIGS. 2 and 4 respectively show the schematic profiles of the prior art cutter and that of the most preferred embodiment of the present invention. While FIG. 4 shows the present invention cutter, having a substantially rectangular profile, the end view of the present invention cutter in FIG. 5 shows all teeth and adaptors 3 equidistant from cutter rotational axis 2 in order that the velocity of each tooth remain within the range required to provide the required Kinetic Energy to shatter hard rock. Each blade 7 of the present invention cutter connects a back ring 6 to a forward rim 5 and comprises a hub 1 and a plurality of spokes 4 connecting hub 1 to rim 5. The number of spokes 4 used is not critical. Although, a rectangular profile is preferred, it is also contemplated for the profile of the present invention cutter to be slightly trapezoidal in configuration, as well as have any other configuration that will maintain the Kinetic Energy of teeth and adaptors 3 in the range required to shatter rock upon impact. As shown in FIG. 3, the teeth and adaptors 3 of the prior art cutter vary widely in their distance from cutter rotational axis 2, and the low velocity teeth fail, as previously explained. Since the accompanying illustrations show the present invention cutter in schematic form, no attempt has been made to identify details of the forward end of the cutter, which should conform to good foundry practice, be sufficiently robust to transmit the assigned horsepower, and while not mandatory, should be largely open to allow the egress of water and dredged solids. Also, while the front end of hub 1 is shown recessed from the forward end of the profile, it could be flush, although in a flush position increased wear may result.

Empirical data from actual rock-dredging operations have disclosed that hard, massive rock along the east coast of the United States can be excavated by a cutter with Kinetic Energy of approximately 611,000 ft-lbs. It should be noted that the inconsistent nature of natural rock may impose the entire Kinetic Energy upon a single tooth, requiring robust tooth and adaptor design. The 611,000 f-lb Kinetic Energy requirement may vary somewhat with the character of the rock being dredged, but operating experience on multiple east coast projects, combined with extensive analysis of the Unconfined Compressive Strength data of the dredged rock, indicate that 611,000 ft-lbs of Kinetic Energy will suffice and provide a reasonable factor of safety.

Figure 6:
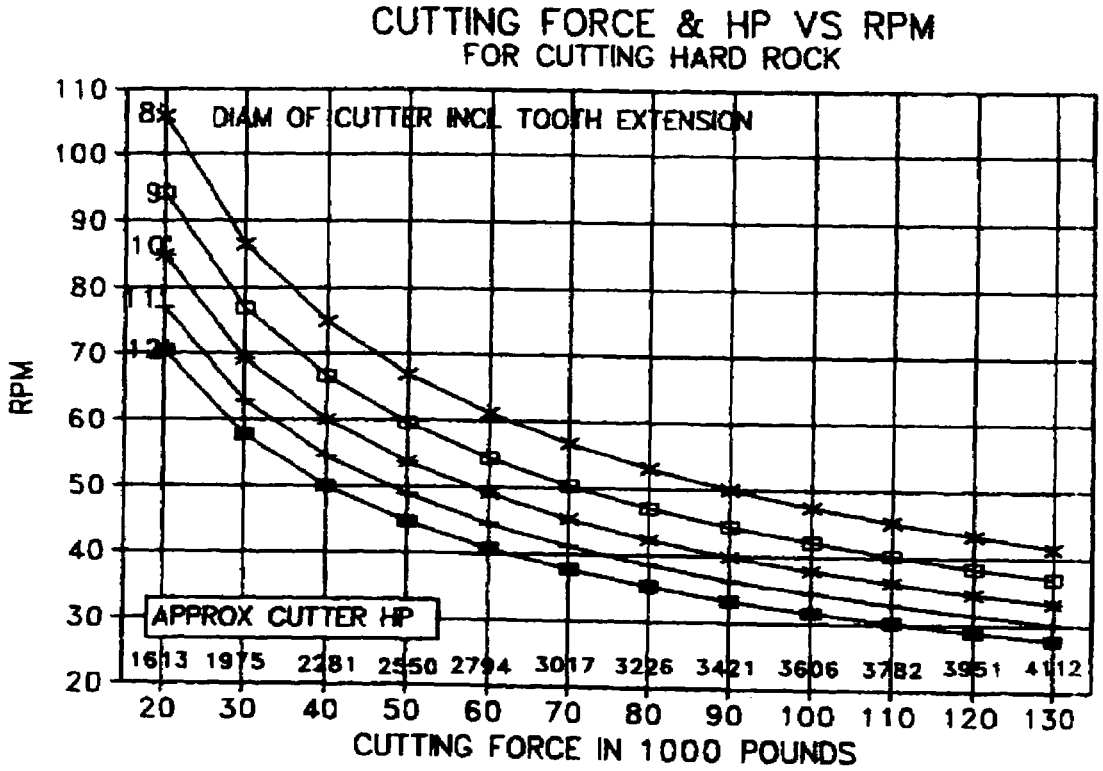
FIG. 6 is a graph plotting the RPM, cutting force, and horsepower needed for various diameter cutters to achieve the necessary Kinetic Energy to successfully excavate hard rock, with the graph being based upon empirical operating data which indicates that 611,000 ft-lbs of Kinetic Energy will successfully cut hard rock.

FIG. 6 plots the RPM, cutting force, and the horsepower (hp) for various diameter cutters (measured tooth tip to tooth tip) to achieve the required Kinetic Energy to cut rock. With this information, the operator can assemble a dredge cutter which will cut rock efficiently, reduce tooth and adaptor failures, increase production rate, and reduce costs per cubic yard dredged. FIG. 6 indicates how the proper application of Kinetic Energy in the form of tooth velocity and cutting force can obviate the need for increasing cutter horsepower by substituting less expensive tooth velocity.

While the invention has been described in connection with a preferred embodiment, it is not intended to limit the scope of the invention to the particular form set forth herein, but on the contrary, it is intended to cover such alternatives, modifications, and equivalents as may be included within the spirit and scope of the invention as defined by the appended claims.

What is claimed is:

1. A method for excavating underwater rock by shattering the rock comprising the steps of:

(a) providing a machine including a rotatable cutter;
  the cutter comprising:
    a forward rim;
    a back ring;
    a plurality of blades, each blade attached at one end to the rim and at the other end to the ring; and
    a plurality of cutting teeth mounted on each blade, each of the teeth mounted at approximately the same distance from the rotational axis of the cutter;

(b) determining the kinetic energy required to shatter the underwater rock with the cutting teeth;

(c) using said required kinetic energy, and said distance to determine the minimum rotational speed required to shatter the underwater rock;

(d) rotating the cutter at a speed at least as fast as said minimum rotational speed;

(e) contacting the cutting teeth with the underwater rock; and (f) shattering the underwater rock.

2. The method of claim 1, wherein said forward rim and said back ring have approximately the same diameter.

3. The method of claim 1, further comprising the steps of providing an adaptor to mount each tooth on the blades; and also comprising the step of removably supporting a tooth within each adaptor.

4. The method of claim 3, wherein the adaptors are configured to quick tooth replacement.

5. The method of claim 1, wherein each tooth is exposed to approximately the same maximum stress.

6. The method of claim 1, wherein each tooth is moving at approximately the same velocity.

7. The method of claim 1, wherein the blades are positioned to provide a substantially non-tapering profile to the cutter.

8. The method of claim 7, wherein the profile is substantially rectangular.

* * * * *